US010675212B2

(12) United States Patent
Jaques

(10) Patent No.: US 10,675,212 B2
(45) Date of Patent: Jun. 9, 2020

(54) SELF-ERECTING PENIS

(71) Applicant: LOVEHONEY LIMITED, Bath (GB)

(72) Inventor: Paul Jaques, Bath (GB)

(73) Assignee: Lovehoney Group Ltd., College Park, GA (US)

( * ) Notice: Subject to any disclaimer, the term of this patent is extended or adjusted under 35 U.S.C. 154(b) by 178 days.

(21) Appl. No.: 15/921,058

(22) Filed: Mar. 14, 2018

(65) Prior Publication Data

US 2018/0353373 A1 Dec. 13, 2018

(30) Foreign Application Priority Data

Jun. 8, 2017 (GB) ..... 1709117.4

(51) Int. Cl.
*A61H 19/00* (2006.01)

(52) U.S. Cl.
CPC ..... *A61H 19/44* (2013.01); *A61H 19/50* (2013.01); *A61H 19/34* (2013.01); *A61H 2201/013* (2013.01); *A61H 2201/1215* (2013.01); *A61H 2201/1463* (2013.01); *A61H 2201/1481* (2013.01); *A61H 2201/165* (2013.01); *A61H 2201/1652* (2013.01); *A61H 2201/1676* (2013.01)

(58) Field of Classification Search
CPC ..... A61H 19/34; A61H 19/44; A61H 19/50; A61H 2201/1215; A61H 2201/1676
See application file for complete search history.

(56) References Cited

U.S. PATENT DOCUMENTS

2010/0036196 A1* 2/2010 Walch ..... A61F 2/26 600/40
2012/0271101 A1 10/2012 Tan
2014/0135573 A1 5/2014 Dees

FOREIGN PATENT DOCUMENTS

WO 2011007167 1/2011
WO 2013098824 7/2013
WO 2016113531 7/2016

* cited by examiner

*Primary Examiner* — Christine H Matthews
(74) *Attorney, Agent, or Firm* — Eandi Fitzpatrick LLP; William Fitzpatrick

(57) ABSTRACT

A dildo assembly comprising a housing, and a dildo, having a base at one end and a tip at the opposite end, attached at its base to the housing and comprising a plurality of hinged segments, wherein the plurality of hinged segments are moveable between a first configuration, in which the dildo is curved, and a second configuration in which the dildo extends substantially straight away from the housing.

8 Claims, 5 Drawing Sheets

SELF-ERECTING PENIS

BACKGROUND

The field of sex toys is a well-developed area of technology. Many sex toys are known in the art for the purposes of stimulating sexual pleasure, either on one's own or with a partner. For example, dildos for vaginal or anal insertion, which can be manually operated or electrically powered for vibration.

The present invention concerns an improved dildo. Dildos are generally one-piece or may be extensible, e.g. telescopically. However, prior art dildos suffer from certain drawbacks. For example, while prior art dildos may be able to replicate the shape and rigidity of an erect penis, they are unable to accurately replicate the transition of a penis from flaccid to erect. This function may be desirable if, for example, the dildo is intended to be worn discretely beneath clothes for subsequent use after disrobing. It may also be desirable to fulfil certain functions in roleplaying, while avoiding the need to use two separate dildos to simulate flaccidity and erection.

It is an aim of the present invention to overcome some of the drawbacks set out above. This aim is achieved by providing a dildo comprising a plurality of segments, which may be moved between a first, flaccid configuration and a second, erect configuration, for example through manipulation by a drive mechanism. Additional technical benefits are achieved by the invention as set out in the description below.

SUMMARY OF THE INVENTION

In accordance with a first aspect of the present invention there is provided a dildo assembly comprising:

a housing; and a dildo, having a base at one end and a tip at the opposite end, attached at its base to the housing and comprising a plurality of hinged segments;

wherein the plurality of hinged segments are moveable between a first configuration, in which the dildo is curved, and a second configuration in which the dildo extends substantially straight away from the housing.

The housing may contain a mechanism operable to move the plurality of hinged segments between the first and second configurations. The mechanism may comprise a cord running between the tip of the dildo and a pulley wheel located in the housing, whereby rotation of the pulley wheel draws the tip of the dildo towards the pulley wheel via the cord. The pulley wheel may be rotationally coupled to an electric motor located within the housing. The pulley wheel may be rotationally coupled to the electric motor via a reduction gear system. The pulley wheel may rotationally coupled to the electric motor via a worm gear and worm wheel. The mechanism may comprise a source of electrical power coupled to the electric motor. The electric motor may be coupled to the source of electrical power source via a controller. The controller may be configured to automatically cut-off the electric motor from the source of electrical power. The controller may comprise a wireless connectivity module.

DETAILED DESCRIPTION

Figure 1:
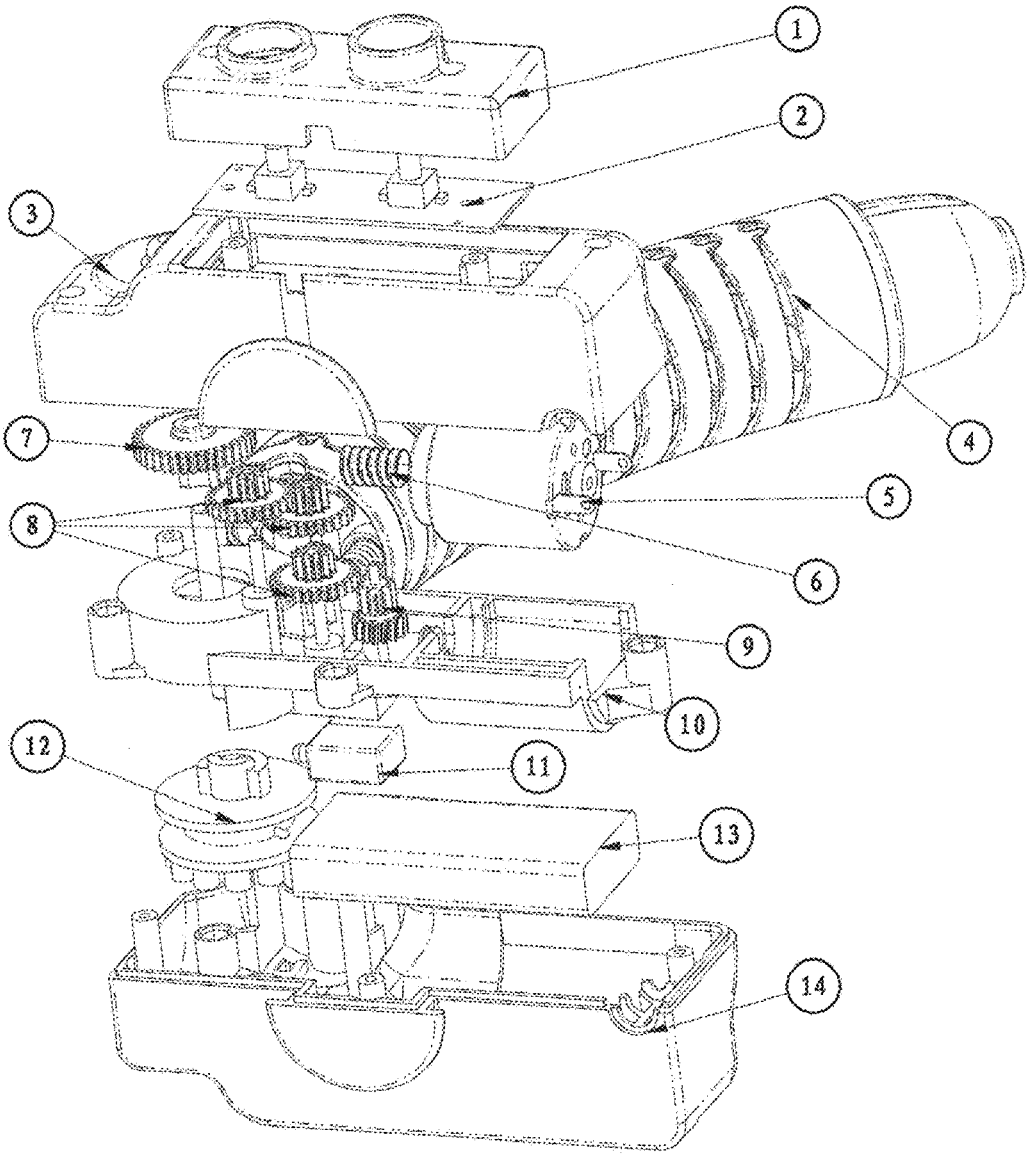
Figure 2:
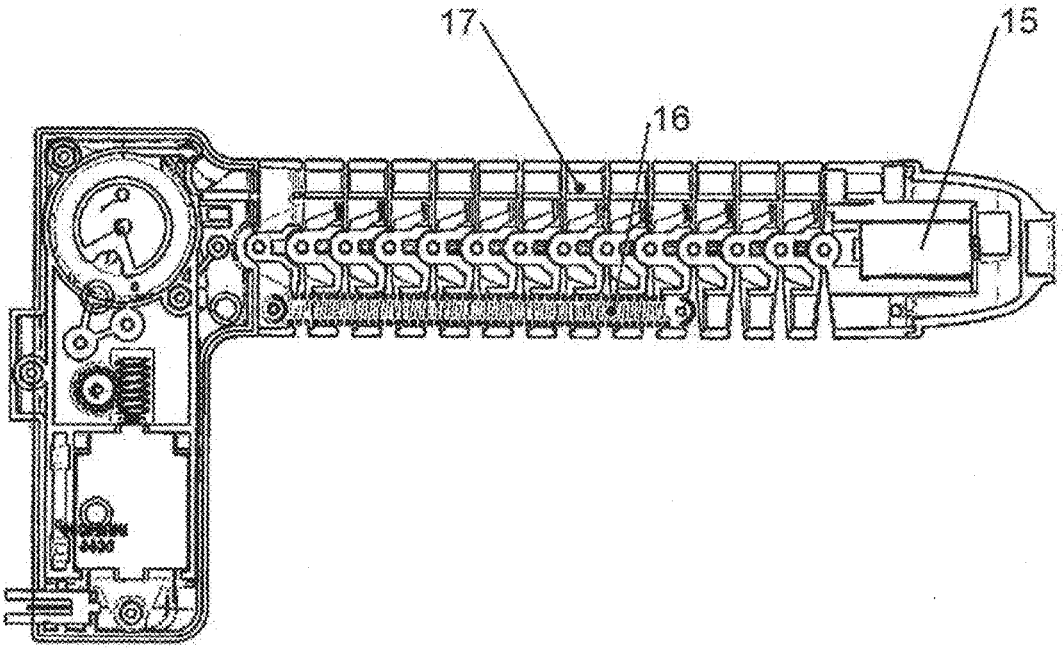
Figure 3:
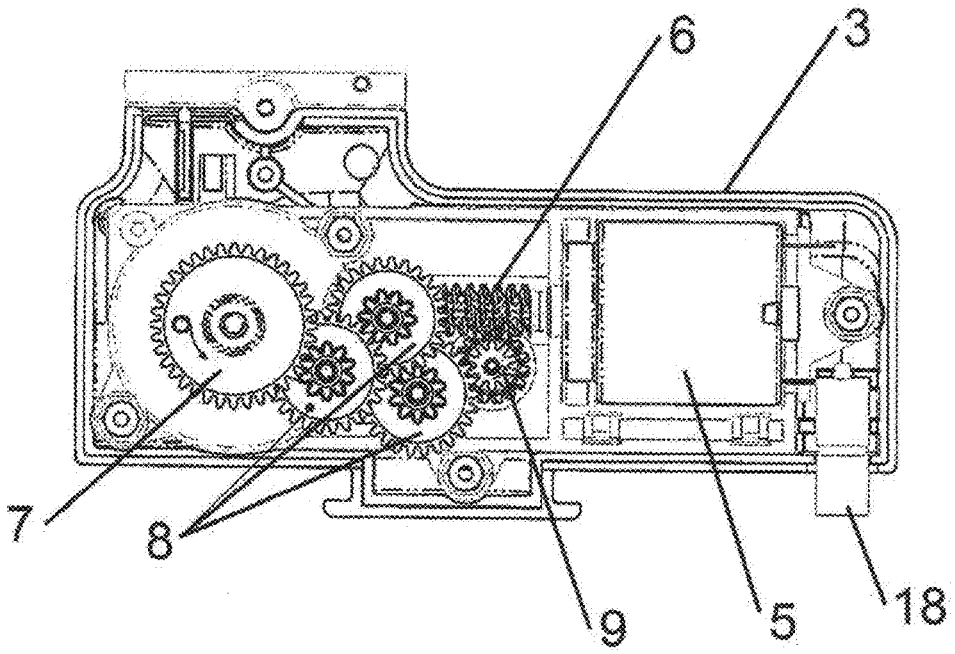
Figure 4:
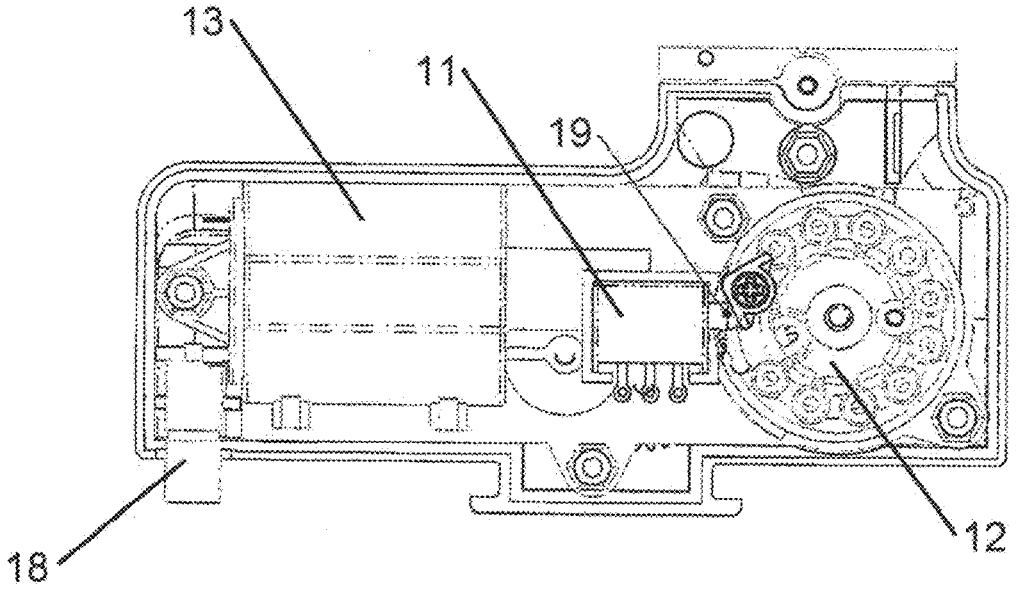
Figure 5:
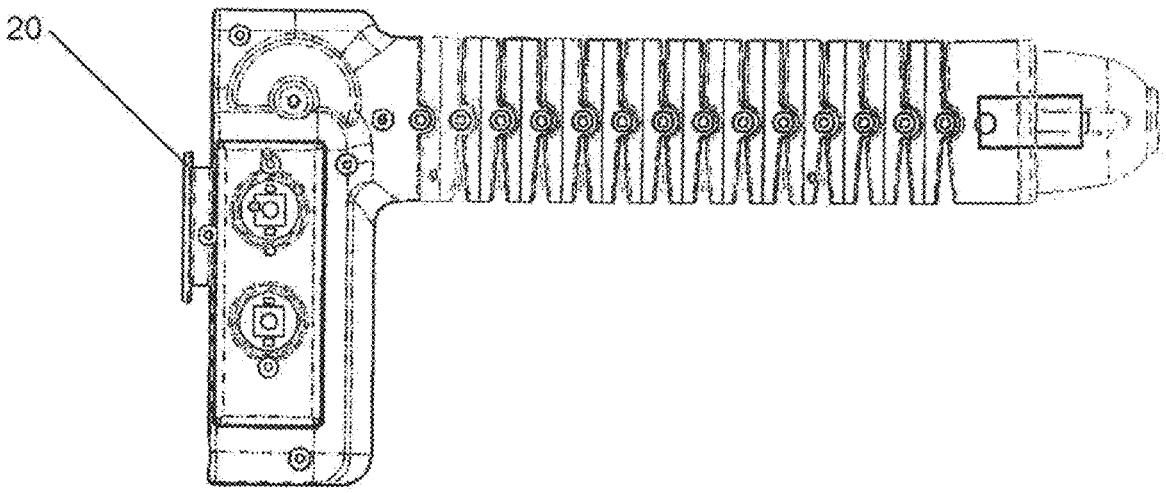

The invention will now be described with reference to the accompanying drawing, in which:

FIG. 1 schematically shows an exploded perspective view of a dildo assembly in accordance with an embodiment of the present invention;

FIG. 2 schematically shows a cross-sectional view of the dildo assembly of FIG. 1;

FIG. 3 schematically shows a cross-sectional view of the first housing section of the dildo assembly of FIG. 1;

FIG. 4 schematically shows a cross-sectional view of the second housing section of the dildo assembly of FIG. 1; and FIG. 5 schematically shows a side view of a dildo assembly in accordance with a further embodiment of the present invention.

FIG. 1 schematically shows an exploded perspective view of a dildo assembly in accordance with an embodiment of the present invention. The dildo assembly comprises a switch cover 1, a printed circuit board (PCB) 2, a first housing section 3, a dildo 4, an electric motor 5, a worm gear 6, a main cog 7, three intermediate cogs 8, a worm wheel 9, a housing insert 10, a controller 11, a pulley wheel 12, a battery 13 and a second housing section 14. When assembled, the first and second housing sections 3, 14 combine to form a housing.

The method of operation is as follows:

Initially, the dildo 4 is in the flaccid state, i.e. wherein the dildo curves towards the housing, such that the tip of the dildo 4 is proximate the housing. Two switches are located on the switch cover 1. These switches are connected to first and second electronic switches on the PCB 2, underneath the switch cover 1. A first electronic switch is operable to 'activate' the dildo 4, extending it from the flaccid state to an erect state. The first electronic switch is also operable to 'deactivate' the dildo 4, returning it from the erect state to the flaccid state.

When a user presses the first switch on the switch cover 1, the associated electronic switch on the PCB 2 is operated. This causes current to flow from the battery 13 to the electric motor 5, via the controller 11 along a plurality of wires (not shown).

Once activated, the electric motor 5 rotates the worm gear 6, which is attached to an output shaft of the electric motor 5, in a first direction. The rotational force provided by the electric motor 5 is shifted through 90° through the interaction of the worm gear 6 with the worm wheel 9. The rotational force is then transmitted through the three intermediate cogs 8 to the main cog 7. Each of the intermediate cogs 8 are arranged to form a reduction gear system, i.e. as the rotational force is transmitted from cog to cog, the driven shaft rotates more slowly than the driving shaft, as is well-known in the art. This is to ensure that the rate of rotation is sufficiently reduced when it is transmitted to the main cog 9 to ensure that the operation of the dildo 4 (described below) realistically replicates the action of an erecting penis.

As the main cog 7 rotates it transmits its rotational force, via a shaft connected to its hub, to the pulley wheel 12. A cord (not shown) is attached to a hub of the pulley wheel 12 and extends through the interior of the dildo 4. The cord is attached at its opposite end to a point on the interior of the tip of the dildo 4, i.e. the segment most distal from the first and second housing sections 3, 14.

As the pulley wheel 12 rotates, the cord is progressively wrapped around the pulley wheel 12 such that its effective overall length from the pulley wheel 12 shortens. This has the effect that the tip of the dildo 4 is drawn toward the pulley wheel 12. The dildo 4 comprises a plurality of hinged section, connected along shared hinge lines at the point where they meet one another, such that each hinged section can rotate slightly with respect to the neighbouring hinged section. This arrangement enables the dildo 4 to smoothly change shape from a first, flaccid configuration, in which the dildo curves towards the plane of the housing sections 3, 14 to lie substantially flat against the housing, to a second, erect configuration, in which the dildo 4 extends substantially straight and perpendicular to the housing.

The controller 11 has a control element located on it, adjacent to the pulley wheel 12. A profiled outer surface of the shaft of the pulley wheel 12 contacts the control element. The controller 11 is configured such that it terminates current flow from the battery 13 to the electric motor 5 when the control element loses contact with the profiled outer surface. This arrangement acts as an automatic cut-off to the movement of the dildo 4 between the first and second configurations. The extent of the profiled outer surface may be varied as appropriate to correspondingly set the extent of the range of motion of the dildo 4.

In this configuration, the user may press the second switch on the switch cover 1. This causes the associated electronic switch on the PCB 2 to be operated, which in turn causes current to flow from the battery 13 via the controller 11 along a plurality of wires (not shown) to a vibration motor 15 housed in the tip of the dildo (see FIG. 2). The operation of the switch may be a simple on/off signal in response to the pressing of the second switch, or the switch may turn the vibration motor 15 on for a pre-determined amount of time (e.g. ten seconds) before automatically turning the vibration motor 15 off again. This operation may be controlled by control circuitry in the controller 11.

When it is desired to return the dildo 4 to its first, flaccid configuration, a user presses the first switch on the switch cover 1 again, and the associated electronic switch on the PCB 2 is operated. This causes current to flow from the battery 13 to the electric motor 5, via the controller 11 along a plurality of wires (not shown). Once activated, the electric motor 5 rotates the worm gear 6, which is attached to an output shaft of the electric motor 5, in a second direction opposite to the first direction.

The operation described above is carried out in the same manner, except that the rotational force transmitted between the cogs is in the opposite direction.

As the pulley wheel 12 rotates in the opposite direction, the cord is paid out from the pulley wheel 12. A coil spring (see FIG. 2) extends from an anchor point on the first and second housing sections, through the dildo 4 to an anchor point at the tip of the dildo 4 where its opposite end is secure. The coil spring biases the dildo 4 into the first configuration, and the cord must overcome this biasing force in order to move the dildo 4 from the first position to the second configuration. Consequently, as the cord is paid out from the pulley wheel 12, the biasing force of the spring takes up the slack and the segments of the dildo 4 move under the force of the spring back into the first configuration.

The controller 11 automatically cuts off the flow of electrical current from the battery 13 to the electric motor 5 as described above, but with the control element reaching the opposite end of the profiled outer surface of the shaft of the pulley wheel 12.

FIG. 2 schematically shows a cross-sectional view of the dildo assembly of FIG. 1. In this view, the vibration motor 15, the spring 16 and the cord 17, referred to in the preceding paragraphs, can each be seen at the points indicated.

FIG. 3 schematically shows a cross-sectional view of the first housing section 3 of the dildo assembly of FIG. 1. Here, the an electric motor 5, the worm gear 6, the main cog 7, the three intermediate cogs 8 and the worm wheel 9 can be seen in their assembled state.

An electrical connector 18 is also shown in this view. The electrical connector 18 is electrically coupled to the battery 13, and so a user can charge the battery 13 by connecting a power source to the electrical connector 18.

FIG. 4 schematically shows a cross-sectional view of the second housing section 14 of the dildo assembly of FIG. 1. The controller 11, the pulley wheel 12 and the battery 13 can be seen in their assembled state. The control element 19 of the controller 11 is also shown in more detail.

Alternative Arrangements

The invention is not limited to the specific embodiments disclosed above, and other possibilities will be apparent to those skilled in the art. For example, only the 'skeleton' of the dildo assembly is shown in FIG. 1. In practice, this would be covered by a sleeve of material designed to replicate the texture of a penis, e.g. silicone. The number of segments can be varied to provide dildos of greater or lesser length to suit individual requirements, and the range of motion can be varied by adjusting the profiled outer surface of the pulley wheel, the controller and the strength of the coil spring.

A suction cup may be formed on the housing, to allow the dildo assembly to be attached to a wall, floor, table or other surface. An example of this embodiment is shown in FIG. 5—see suction cup 20. The suction cup may also be engaged with an o-ring of a strap or harness, so that the dildo assembly can be worn by a user for the purposes of 'pegging' or similar activities. Alternatively or additionally, the housing may comprise mounting points for a strap or harness.

The controller may have a wireless connectivity module to enable the electric motor 5 and/or vibration motor 15 to be operated by a remote control in addition to, or instead of, the switches on the switch cover. The wireless connectivity may take place via any suitable protocol, e.g. the Bluetooth® protocol or wi-fi.

While the embodiments of FIGS. 1-5 have a rechargeable battery, the invention could instead be powered by non-rechargeable batteries that can be removed and replaced by a user.

The invention claimed is:

1. A dildo assembly comprising:

a housing; and a dildo, having a base at one end and a tip at the opposite end, attached at said base to the housing and comprising a plurality of hinged segments;

wherein the plurality of hinged segments are moveable between a first configuration, in which the dildo is curved, and a second configuration in which the dildo extends substantially straight away from the housing;

wherein the housing contains a mechanism operable to move the plurality of hinged segments between the first and second configurations;

wherein the mechanism comprises a cord running between the tip of the dildo and a pulley wheel located in the housing, whereby rotation of the pulley wheel draws the tip of the dildo towards the pulley wheel via the cord.

2. The dildo assembly according to claim 1, wherein the pulley wheel is rotationally coupled to an electric motor located within the housing.

3. The dildo assembly according to claim 2, wherein the pulley wheel is rotationally coupled to the electric motor via a reduction gear system.

4. The dildo assembly according to claim 2, wherein the pulley wheel is rotationally coupled to the electric motor via a worm gear and worm wheel.

5. The dildo assembly according to claim 2, wherein the mechanism comprises a source of electrical power coupled to the electric motor.

6. The dildo assembly according to claim 5, wherein the electric motor is coupled to the source of electrical power via a controller.

7. The dildo assembly according to claim 6, wherein the controller is configured to automatically cut-off the electric motor from the source of electrical power.

8. The dildo assembly according to claim 6, wherein the controller comprises a wireless connectivity module.

* * * * *